United States Patent [19]

Genge et al.

[11] Patent Number: 4,993,108

[45] Date of Patent: Feb. 19, 1991

[54] VACUUM CLEANER WITH ADJUSTABLE NOZZLE SHIELD

[75] Inventors: Kevin Genge; Mmarco Ferrari; Scott Bolbock, all of Bloomington, Ill.

[73] Assignee: White Consolidated Industries, Inc., Cleveland, Ohio

[21] Appl. No.: 383,665

[22] Filed: Jul. 24, 1989

[51] Int. Cl.[5] ..... A47L 5/26

[52] U.S. Cl. ..... 15/383; 15/338; 15/344; 15/417

[58] Field of Search ..... 15/344, 415 R, 383, 15/417, 338

[56] References Cited

U.S. PATENT DOCUMENTS

| | | | |
|---|---|---|---|
| 2,348,861 | 5/1944 | Smellie | 15/416 X |
| 2,664,588 | 1/1954 | Brace | 15/416 |
| 4,454,627 | 6/1984 | Simm et al. | 15/416 X |

FOREIGN PATENT DOCUMENTS

| | | | |
|---|---|---|---|
| 223060 | 6/1985 | German Democratic Rep. | 15/415 R |

*Primary Examiner*—Chris K. Moore

*Attorney, Agent, or Firm*—Pearne, Gordon, McCoy & Granger

[57] ABSTRACT

A vacuum cleaner has a nozzle with an opening and a vacuum pump connected to draw dirt laden air into the opening from exteriorly of said vacuum cleaner. A shield is movably mounted to the vacuum cleaner to have a first position at which a first part of the opening is blocked from passing air and a second position at which a second part of the opening is blocked from passing air. The first part of the opening may be downwardly directed and the second part may be forwardly directed. The shield may be pivotally mounted to the nozzle.

4 Claims, 5 Drawing Sheets

VACUUM CLEANER WITH ADJUSTABLE NOZZLE SHIELD

This invention relates to an improvement in vacuum cleaners, and is especially directed to features useful in portable domestic vacuum cleaners. It is of course apparent that the invention is also applicable to other types of vacuum cleaners.

BACKGROUND OF THE INVENTION

While many types of vacuum cleaners are available for efficiently and easily cleaning horizontal undersurfaces, conventional devices are not readily adaptable to the cleaning of vertical surfaces. Thus, for example, in order to clean the risers of carpeted stairs with most conventional machines, it is necessary for the operator to physically rotate the entire machine and suspend it while urging it horizontally against the riser. In a solution to this problem suggested in U.S. Pat. No. 4,397,060, the nozzle is pivotally mounted to the hand part of the machine, so that the operator may hold the handle in the normal position while cleaning a riser. This arrangement, however, requires a pivotal interconnection between major elements of the device in order to effect the rotation of the entire nozzle.

The present invention is therefore directed to the provision of a vacuum cleaner that overcomes the above disadvantages of known machines.

An object of the present invention is to provide a light-weight, portable, vacuum cleaner having an adjustable shield which can pivoted from one position to another whereby the nozzle opening is changed in orientation in order to vacuum both stair steps and risers, as required.

A further object of the present invention is to provide a hand-held vacuum cleaner having means for changing the flow path of dirt-laden air therein and in which a closable opening is present for providing easy access to the drive belt for replacement purposes.

Another feature of the present invention is to provide a hand-held vacuum cleaner which is reliably effective for the purposes intended.

SUMMARY OF THE INVENTION

Briefly stated, the present invention provides a vacuum cleaner having a nozzle with an opening and a vacuum pump connected to draw dirt laden air into the nozzle via the opening from exteriorly of said vacuum cleaner. A shield is provided that is movably mounted to the vacuum cleaner to have a first position at which a first part of the opening is blocked from passing air and a second position at which a second part of the opening is blocked from passing air. The second part of the opening is different from the first part. The two parts of the opening advantageously face different directions, with respect to the machine. For example, the first part of the opening may face downwardly when the machine is held in the normal position, with the second part of the opening facing forwardly to enable the cleaning a vertical surface forwardly of the machine.

Advantageously the shield is pivotally mounted to the vacuum cleaner.

BRIEF FIGURE DESCRIPTION

In order that the invention may be more clearly understood, it will now be disclosed in greater detail with reference to the accompanying drawings, wherein.

DESCRIPTION OF THE PREFERRED EMBODIMENT

Figure 1:
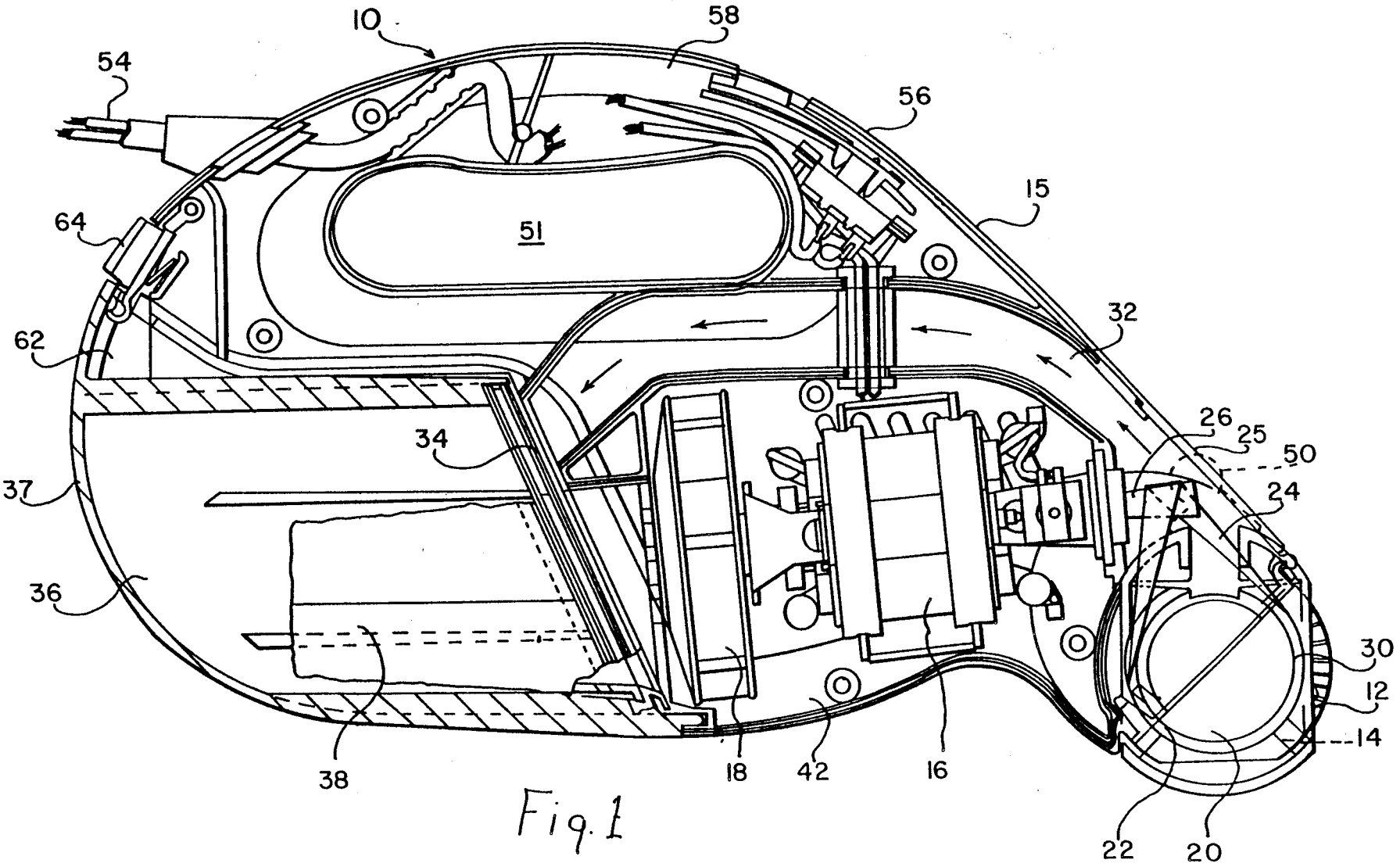
FIG. 1 is a longitudinal sectional view of the vacuum cleaner with adjustable nozzle shield constructed in accordance with the teachings of my invention.

FIG. 1 shows the entire assembly in section constituting a vacuum cleaner having a vacuum pump referred to generally by the reference numeral 10 connected in the device whereby dirt laden air is drawn into the opening 12 of the nozzle 14 in the housing 15. The vacuum pump includes a motor 16 and motor-driven fan 18. A brush roll 20 is positioned within the opening 12 and is rotatably driven by a pulley 22 having a conical longitudinal cross-section belt 24 passing over the pulley as well as the conical-shaped shaft 26. The belt 24 can be replaced by means of opening the door 25 in the front of the housing 15 of the vacuum cleaner in order to expose the belt, as required. The brush roll 20 is provided with a swiveling brush roll cover or shield 30. The air flow or dirt path is shown in channel 32 as indicated by arrows in FIG. 1.

It will be noted that the dirt path communicates with the open end 34 of dirt receptacle 36. The dirt path air flow also continues through a motor filter 38, of the reusable type, with the dirt and debris being trapped in the filter while the relatively clean air passes through fan 18 and motor 16 and out of vacuum cleaner through side grilles (not shown) in the housing section 42. The dirt container 36 can be separated from the main housing by means of a latch release button 64.

Figure 2:
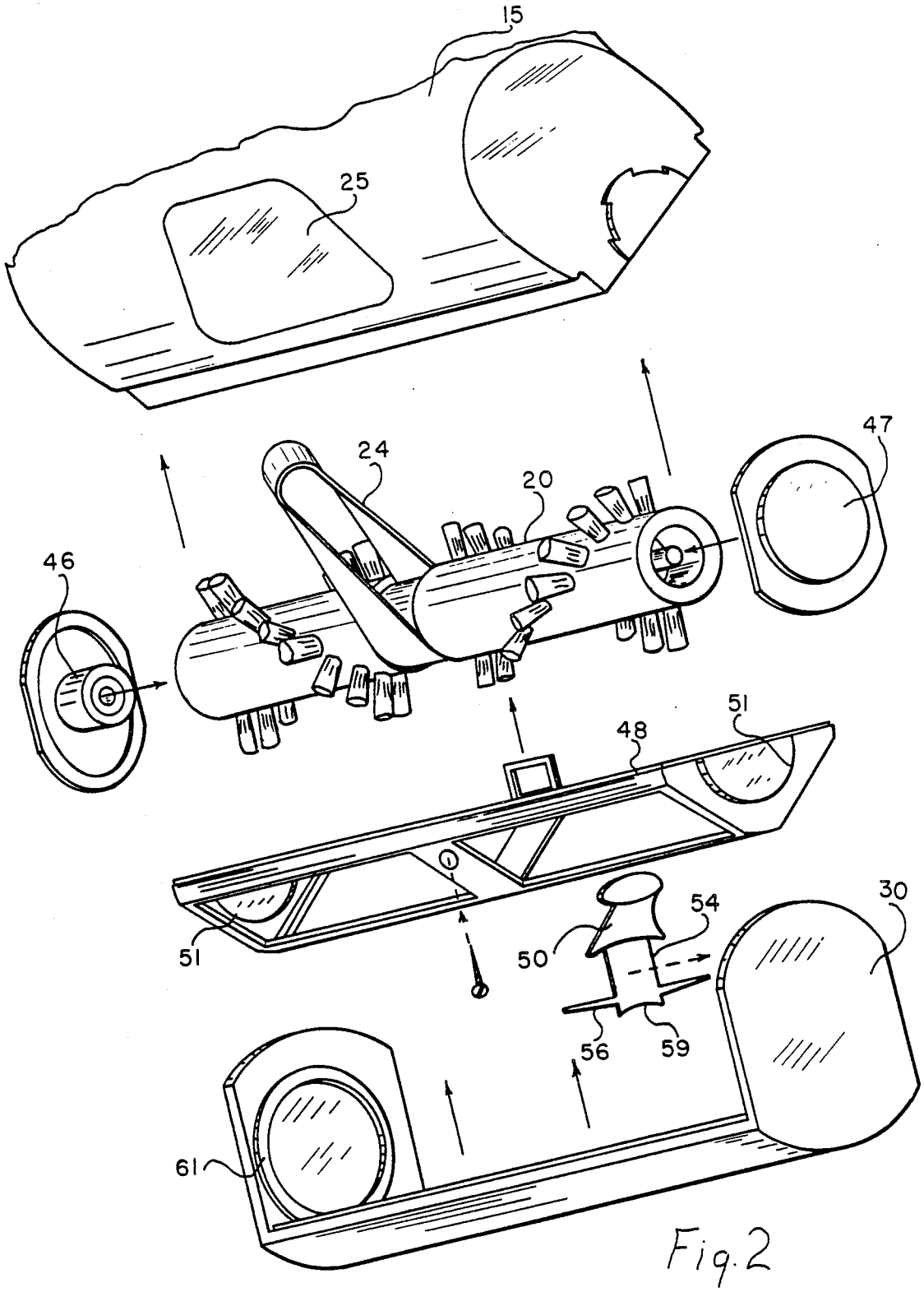
FIG. 2 is an exploded view of the beater bar assembly and a drive belt having a conical longitudinal cross-section and a housing for said assembly.
Figure 3:
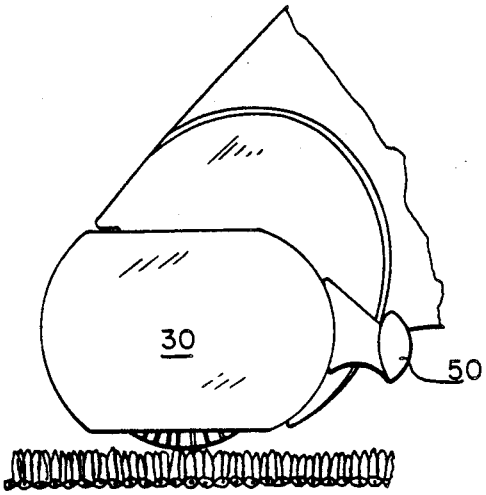
FIG. 3 is a side elevational view of the nozzle shield with the operating lever disposed generally horizontally whereby the brush beater bar projects through an opening for cleaning a horizontal surface.
Figure 4:
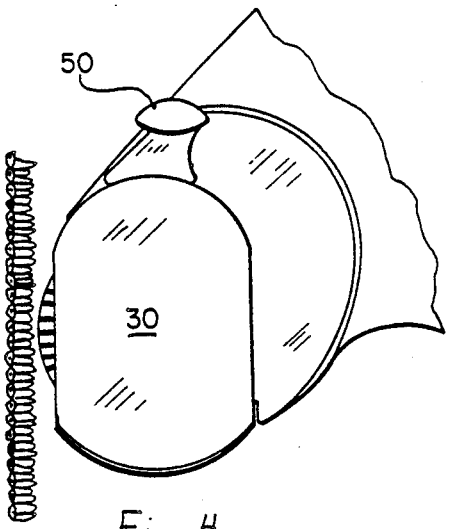
FIG. 4 is a side elevational view similar to that shown in FIG. 3 wherein the brush beater bar projects through an opening for cleaning a vertical surface.
Figure 7:
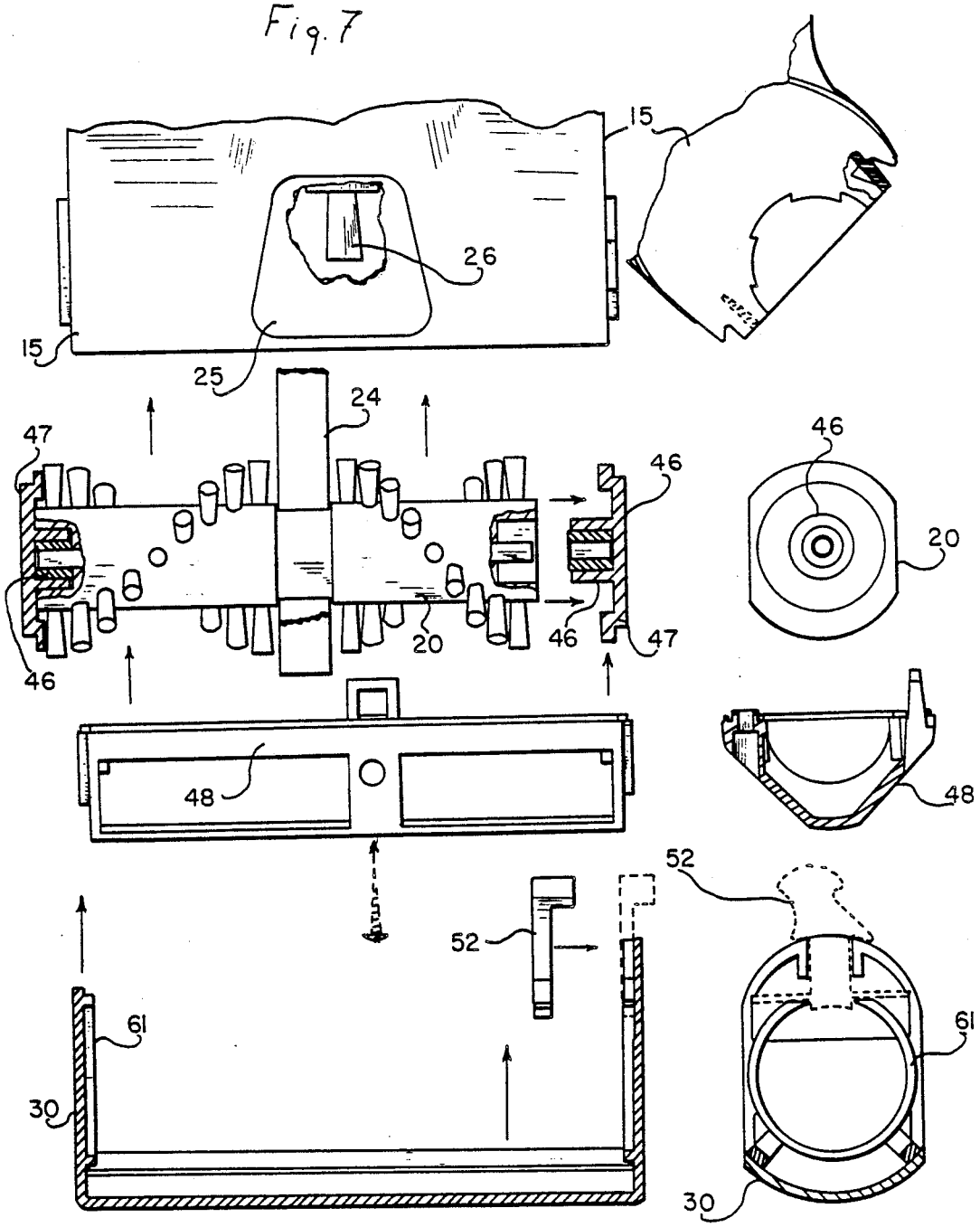
FIG. 7 is an exploded view in both front elevation and side elevation of the assembly of the beater-brush, cover and belt of the invention.
Figure 10:
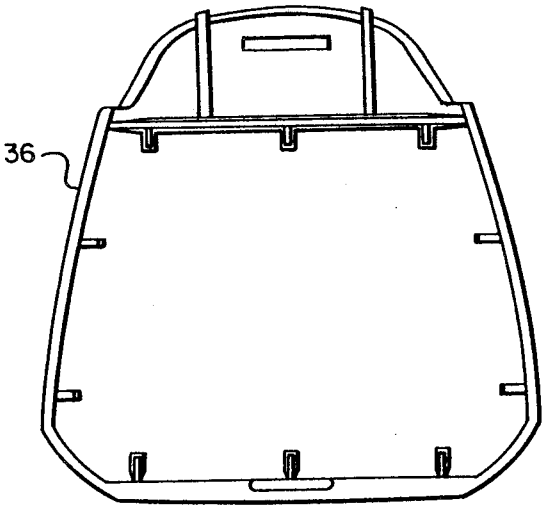
FIG. 10 is an elevational view of the open end of the dirt receptacle shown in FIGS. 8 and 9 and FIG. 11 is an elevational view of the closed end of the dirt receptacle showing the latch therein.
Figure 11:
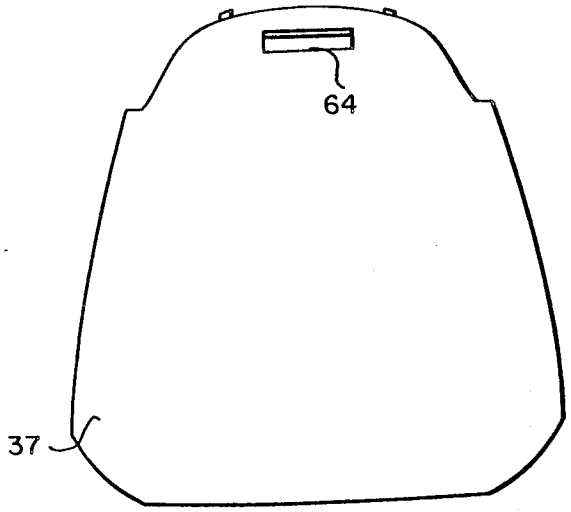
Figure 8:
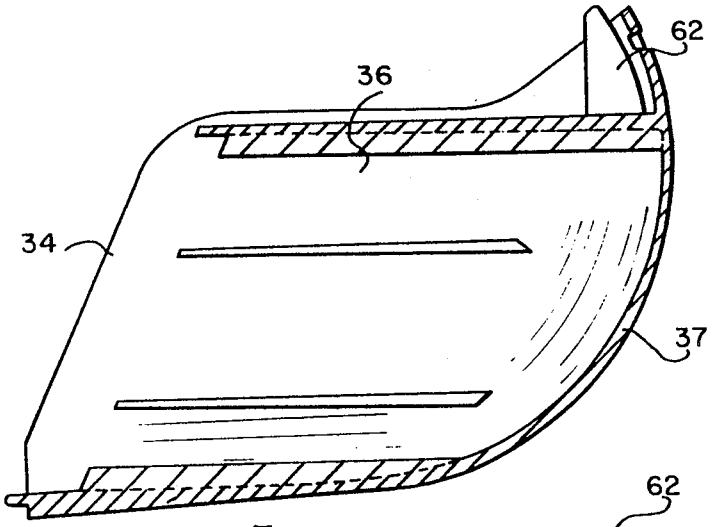
FIG. 8 is a sectional view of the removable dirt receptacle of the present vacuum cleaner with adjustable nozzle shield.
Figure 9:
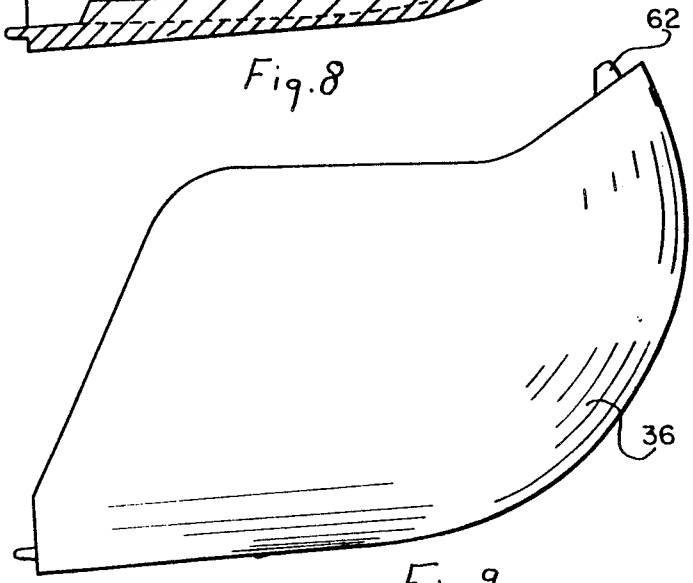
FIG. 9 is a side elevation of the dirt receptacle shown in FIG. 8.

Referring to FIGS. 2 and 7, the brush roll assembly and accompanying structure is shown in exploded views in which the brush roll 20 is provided with end bearings 46. A subcover or sole plate 48 is provided with cut-out semi-circular parts 51 which fit over the brush roll 20 and bearings 46.

The shield 30 is adapted for moving from horizontal to vertical position, and vice versa, by means of a lever 50 shown in FIGS. 3–6. The lever 50 has a downward post 54 having opposed fingers 56 which are held in grooves or indentations 58 in the inside surfaces of the shield 30. The shield is mounted to pivot or swivel from a horizontal to a vertical position, and vice versa, as seen in FIGS. 3–6.

As seen in FIG. 7 the lever 50 is shown in dotted lines affixed to an inside wall of shield 30. The brush roll 20 and sole plate 48 is also shown an exploded view. The bearings 46 are shown both attached and detached from the brush roll 20. The front of the housing 15 is shown having a door 25, and behind the door, a conical drive shaft 26 for the belt 24. The door 25 in the front of the housing 15 is shown broken away revealing the conical drive shaft 26.

Referring to FIG. 1, the present vacuum device is provided with an AC supply cord 54 as well as an on-off switch 56. It should be noted that it is within the scope of the present invention to utilize a D.C. battery for providing power to the present vacuuming device. The device is further provided with a handle 58 having finger openings 51 for ease of use in vacuuming, as well as transporting the device.

Figure 6:
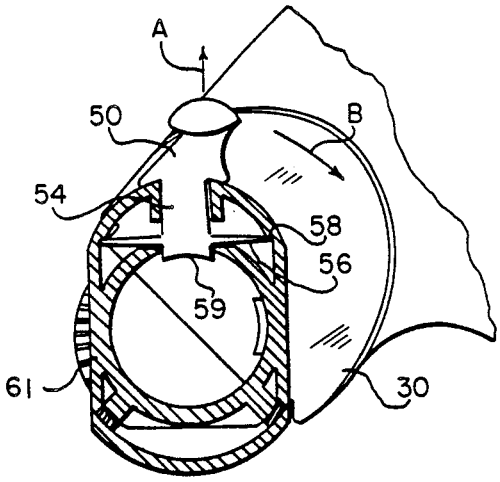
FIG. 6 is a sectional view of the nozzle shield as seen in FIG. 4.
Figure 5:
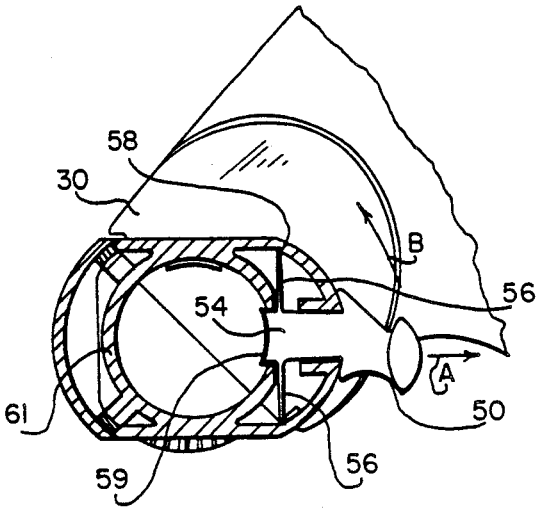
FIG. 5 is a sectional view of the nozzle shield as seen in FIG. 3.

As seen in FIGS. 5 and 6 the lever 50 is provided with lateral projections, the ends 55 of which are held in grooves 58 of the shield 30. The lever 50 is fabricated of a slightly bendable material, such as a themoplastic, so that it may be pulled in a direction away from the shield as shown by the arrow A, and rotated in the direction of the arrow B, so that the curved end 59 on the post 54 of the lever 50 can clear the obstruction of the circular bearings 61 so that the shield 30 can be rotated, as shown in FIGS. 5 and 6. However, since the lever 50 is somewhat resilient, and after it is released from its pulled out position, it will return to its rest position in which post 54 is latched to circular projection 47 on the outer surface of bearing plate **46*a*** and the shield is prevented from rotating.

Referring now to FIGS. 8–11 in which is shown the dust receptacle or container 36 having an open end 34 which, as stated hereinbefore communicates with the dirt path 32. The closed rear end 37 of the receptacle is provided with an upwardly directed projection 62 which is engaged by a catch 64 forming a latching arrangement for the dust receptacle 36, as clearly seen in FIG. 1. The receptacle 36 can be fabricated of semi-transparent material so that amount of dirt, dust and debris picked up by the vacuum and deposited in the receptacle, at any given time, can be observed by the user.

While the invention has been disclosed with reference to a single embodiment thereof, it will be apparent that many variations may be made therein, and it is therefore intended in the following claims to cover each such variation and modification as falls within the true spirit and scope of the invention.

What is claimed is:

1. In a vacuum cleaner having a nozzle with an opening, a brush roller mounted within said nozzle adjacent said opening for rotation about a given axis, means for rotating said brush roller, and a vacuum pump connected to draw dirt laden air into said nozzle via said opening from exteriorly of said vacuum cleaner, the improvement comprising a shield and means for movably mounting said shield to said vacuum cleaner on the exterior of said nozzle to have a first position at which a first part of said opening is blocked from passing air and a second position at which a second part of said opening is blocked from passing air, said second part being different from said first part, said shield blocking a part of said opening and covering a portion of said brush roller when the shield is in either of said first and second positions.

2. The vacuum cleaner of claim 1 wherein said shield is pivotally mounted to said vacuum cleaner.

3. In a vacuum cleaner having an opening, a brush roller mounted in said nozzle adjacent said opening for rotation about a given axis, said brush roller having a diameter sufficiently small that said brush roller does not extend through said opening, said opening having opposed edges spaced with respect to the circumferential surface of said brush roller to expose a predetermined arc of the circumferential surface of said brush roller, means for rotating said brush roller, and a vacuum pump for drawing dirt laden air into said nozzle via said opening, the improvement comprising a shield and means for pivotally mounting said shield to said first and second positions for blocking different circumferential portions of said opening.

4. The vacuum cleaner of claim 3 further comprising latch means for releasably holding said shield at said first and second positions.

* * * * *

UNITED STATES PATENT AND TRADEMARK OFFICE

CERTIFICATE OF CORRECTION

PATENT NO. : 4,993,108

DATED : February 19, 1991

INVENTOR(S) : Kevin Genge, et al.

It is certified that error appears in the above-identified patent and that said Letters Patent is hereby corrected as shown below:

ON TITLE PAGE: under [75] listing the inventors, "Mmarco" should be --Marco--.

Signed and Sealed this

First Day of September, 1992

*Attest:*

DOUGLAS B. COMER

*Attesting Officer*

*Acting Commissioner of Patents and Trademarks*